US005153433A

United States Patent [19]

Andresen et al.

[11] Patent Number: 5,153,433

[45] Date of Patent: Oct. 6, 1992

[54] PORTABLE MASS SPECTROMETER WITH ONE OR MORE MECHANICALLY ADJUSTABLE ELECTROSTATIC SECTORS AND A MECHANICALLY ADJUSTABLE MAGNETIC SECTOR ALL MOUNTED IN A VACUUM CHAMBER

[75] Inventors: Brian D. Andresen; Joel D. Eckels, both of Livermore; James F. Kimmons, Manteca; Walter H. Martin, Byron; David W. Myers, Livermore; Robert F. Keville, Acampo, all of Calif.

[73] Assignee: The United States of America as represented by the United States Department of Energy, Washington, D.C.

[21] Appl. No.: 757,418

[22] Filed: Sep. 10, 1991

[51] Int. Cl.[5] ..... H01J 49/32

[52] U.S. Cl. ..... 250/296; 250/396 R; 250/299; 250/283

[58] Field of Search ..... 250/296, 294, 298, 299, 250/396 R, 283

[56] References Cited

U.S. PATENT DOCUMENTS

| | | | |
|---|---|---|---|
| 2,947,868 | 8/1960 | Herzog | 250/296 |
| 3,641,339 | 2/1972 | McCormick | 250/296 |
| 3,671,737 | 6/1972 | Hull | 250/296 |
| 3,950,641 | 4/1976 | Evans et al. | 250/296 |
| 4,442,353 | 4/1984 | Baubron | 250/281 |
| 4,588,889 | 5/1986 | Naito | 250/296 |
| 4,641,541 | 2/1987 | Sharp | 250/288 |
| 4,859,848 | 8/1989 | Bowman et al. | 250/296 |
| 4,888,295 | 12/1989 | Zaromb et al. | 436/161 |

*Primary Examiner*—Janice A. Howell
*Assistant Examiner*—Jim Beyer
*Attorney, Agent, or Firm*—Miguel A. Valdes; Henry P. Sartorio; William R. Moser

[57] ABSTRACT

A portable mass spectrometer is described having one or more electrostatic focusing sectors and a magnetic focusing sector, all of which are positioned inside a vacuum chamber, and all of which may be adjusted via adjustment means accessible from outside the vacuum chamber. Mounting of the magnetic sector entirely within the vacuum chamber permits smaller magnets to be used, thus permitting reductions in both weight and bulk.

20 Claims, 8 Drawing Sheets

PORTABLE MASS SPECTROMETER WITH ONE OR MORE MECHANICALLY ADJUSTABLE ELECTROSTATIC SECTORS AND A MECHANICALLY ADJUSTABLE MAGNETIC SECTOR ALL MOUNTED IN A VACUUM CHAMBER

BACKGROUND OF THE INVENTION

The invention described herein arose in the course of, or under, Contract No. W-7405-ENG-48 between the United States Department of Energy and the University of California.

This invention relates to a portable mass spectrometer. More particularly, this invention relates to a portable mass spectrometer having one or more adjustable electrostatic sectors and an adjustable magnetic sector located within a vacuum chamber.

A mass spectrometer is conventionally provided with one or more electrostatic sectors or analyzers to provide a velocity focusing sector for an ion beam regardless of the mass of the ions in the beam. Such an electrostatic sector usually comprises two curved electrodes of opposite polarity between which an ion beam from an ion beam source passes. Conventionally, such an electrostatic sector is mounted in the mass spectrometer in a fixed position with respect to the ion beam source. Minor adjustments in focusing of the ion beam are then made by adjusting the voltage on the curved electrodes of the electrostatic sector.

The mass spectrometer is also provided with a magnetic sector comprising two spaced apart magnets of opposite polarity between which the ion beam also passes to thereby deflect the ion beam proportional to the mass of the ions in the beam. Such magnets, which may constitute either permanent or electromagnetic magnets, are also conventionally fixed in position in the apparatus relative to the ion beam source and electrostatic sector(s).

Such mass spectrometers are well know in the art as shown, for example, in Herzog U.S. Pat. No. 2,947,868, which discloses a mass spectrometer wherein two electrostatic sectors, denominated as toroid condensers by the patentee, are positioned within an evacuated envelope along an ion beam path to apply an electric field transverse to the ion beam. A pair of pole pieces are also stationed along the beam path, but outside of the envelope, to subject the beam to a magnetic field.

McCormick U.S. Pat. No. 3,641,339 describes a mass spectrometer wherein an ion beam from an ion beam source passes through an electrostatic analyzer, a beam monitor electrode, and thereafter through a magnetic sector to a beam current collector.

Evans et al. U.S. Pat. No. 3,950,641 discloses mass spectrometers wherein, in one embodiment, an ion beam passes through a first electrostatic analyzer, then through a magnetic analyzer, and then through a second electrostatic analyzer wherein the ion beam is deflected in circular fashion through 270° back toward the ion beam source.

Bowman et al. U.S. Pat. No. 4,859,848 discloses a mass spectrometer, including an electrostatic analyzer and a magnetic analyzer, which utilizes a one-piece body to provide the desired registration of parts.

While the ion beam travels in an evacuated envelope or vacuum chamber in the prior art mass spectrometer structures described above, conventionally the magnets used for deflection of the ion beam in the magnetic sector of such structures are mounted outside of the vacuum chamber to reduce the amount of outgassing in the vacuum chamber. This, in turn, results in a large space between the opposite poles of the magnets, which necessitates the use of large magnets to provide sufficient magnetic field strength in the magnetic sector, since the magnitude of the magnetic field developed by the magnets is dependent upon the spacing between the poles of the magnets as well as the size and field strength of the individual magnets.

It would, therefore, be desirable to provide a portable mass spectrometer utilizing one or more electrostatic sectors and a magnetic sector to focus the ion beam in accordance with the mass and energy of the beam wherein the size of the magnets used to provide the magnetic focusing of the beam could be reduced, making the apparatus more conducive to portability, and wherein more flexible electrostatic and magnetic focusing could be achieved.

SUMMARY OF THE INVENTION

It is, therefore, an object of this invention to provide a portable mass spectrometer having a magnetic focusing sector comprising magnets located within the evacuated chamber through which the ion beam to be focused travels.

It is another object of this invention to provide a portable mass spectrometer having one or more adjustable electrostatic sectors and an adjustable magnetic focusing sector within the evacuated chamber through which the ion beam to be focused travels.

It is yet another object of this invention to provide a portable mass spectrometer having one or more electrostatic sectors and a magnetic focusing sector, including the magnets used to focus the ion beam, located within the evacuated chamber through which the ion beam to be focused travels, wherein adjustment means for focusing the one or more electrostatic sectors and the magnetic sector are accessible from outside the evacuated chamber.

These and other objects of the invention will be apparent from the following description and accompanying drawings.

DETAILED DESCRIPTION OF THE INVENTION

The invention generally comprises a portable mass spectrometer having one or more electrostatic focusing sectors and a magnetic focusing sector, all of which are positioned inside a vacuum chamber, and all of which may be adjusted via adjustment means accessible from outside the vacuum chamber. The entire structure may be mounted in a case for ease in transporting the device. Mounting of the magnetic sector entirely within the vacuum chamber permits smaller magnets to be used, thus permitting reductions in both weight and bulk. Since transporting of the spectrometer may result in misalignment of the electrostatic sector or sectors, and the magnetic sector, provision is made for external adjustment or refocusing of the ion beam in the magnetic sector and/or the electrostatic sector or sectors.

a. General Description of Mass Spectrometer

Figure 1:
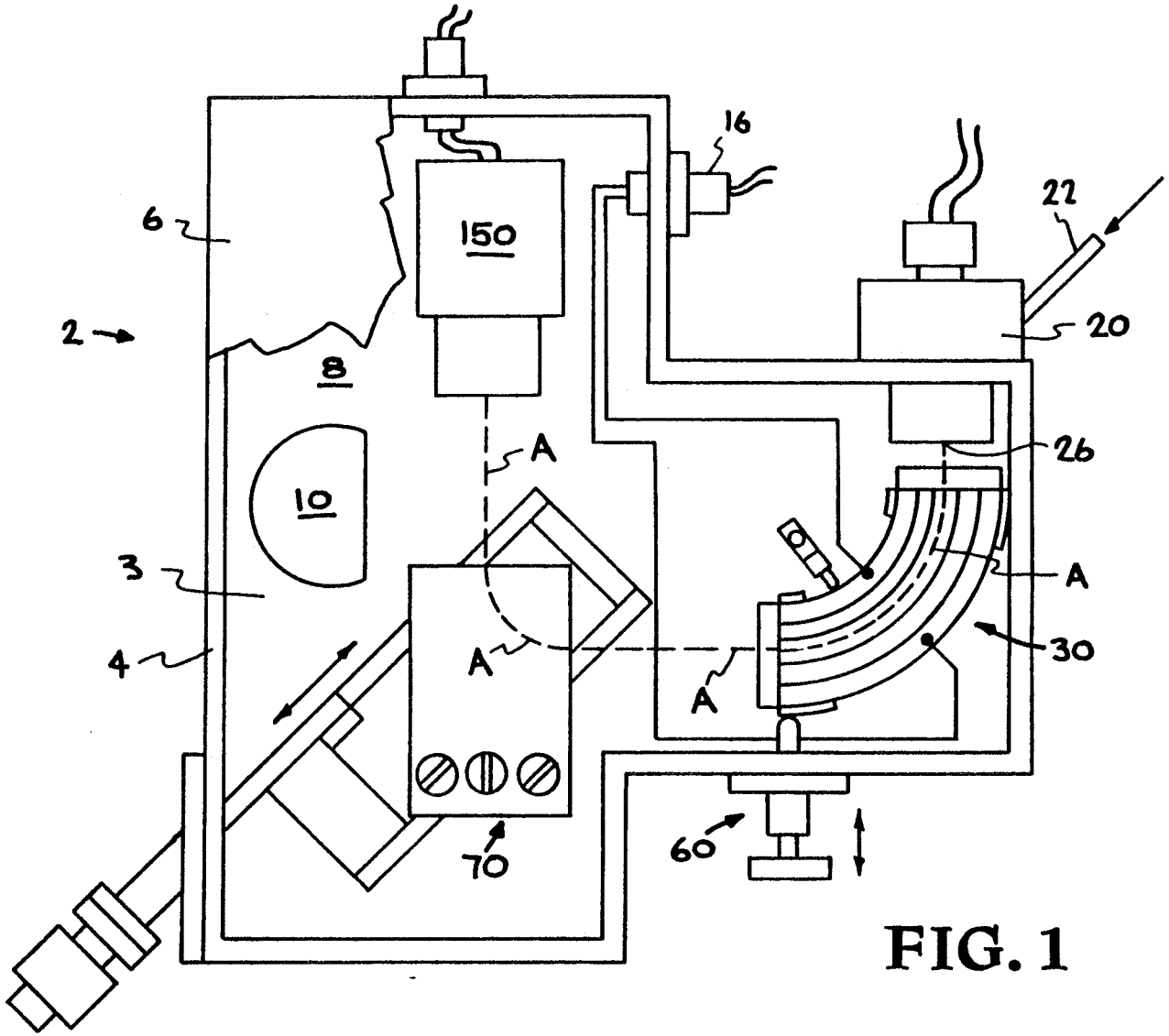
FIG. 1 is a partially cutaway top view of one embodiment of the mass spectrometer of the invention wherein a single electrostatic sector and a magnetic sector are utilized to focus the ion beam.

FIG. 1 illustrates generally at 2 the mass spectrometer of the invention in its simplest form comprising a vacuum chamber 3 with a vacuum chamber wall 4 having top member 6 and bottom member 8 removably sealed thereto to form vacuum chamber 3. Mass spectrometer 2 comprises a single electrostatic sector in the ion beam path followed by a magnetic sector.

Figure 2:
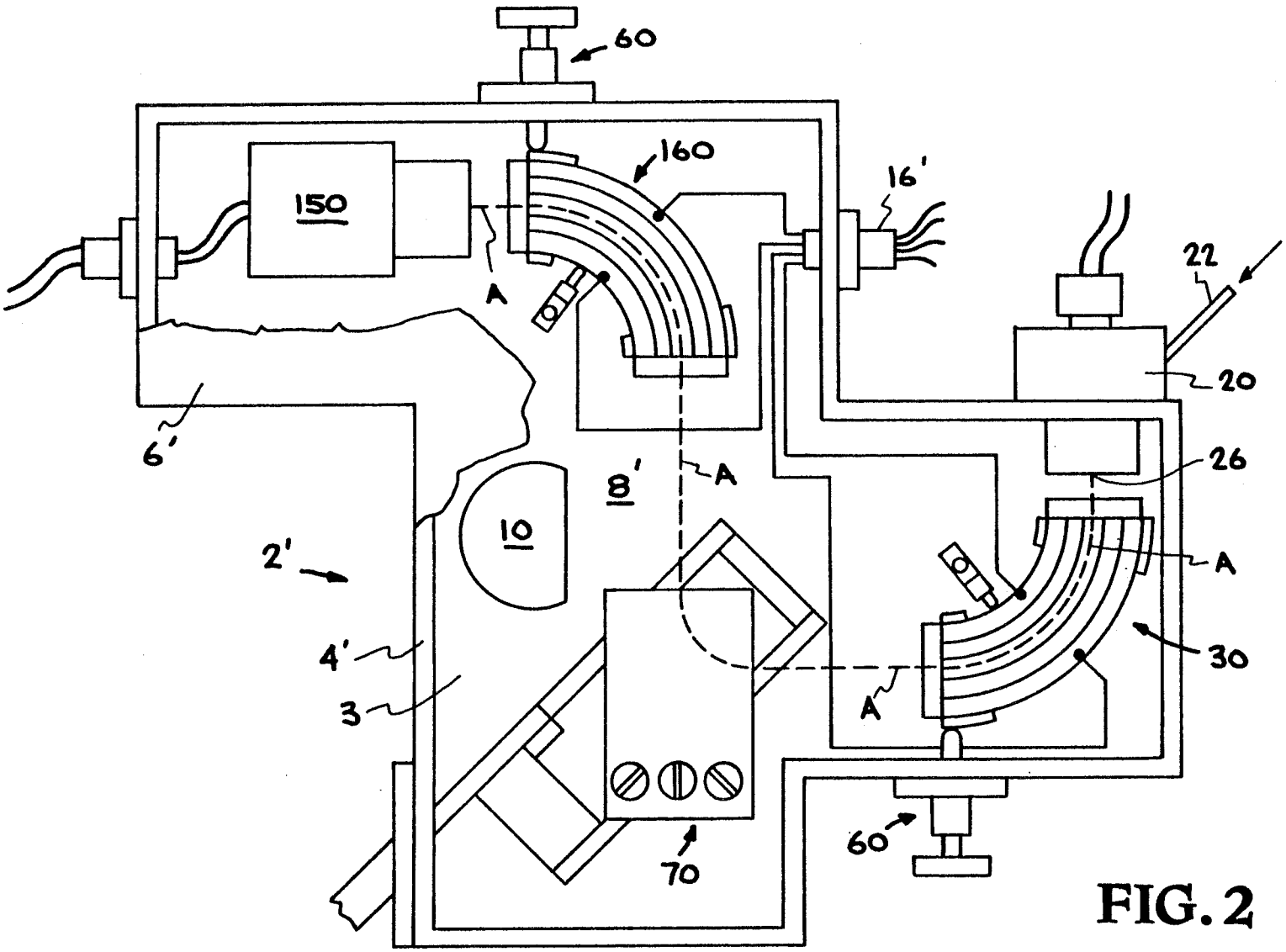
FIG. 2 is a partially cutaway top view of another embodiment of the mass spectrometer of the invention wherein a first electrostatic sector is positioned in the ion beam flight path before the magnetic sector and a second electrostatic sector is positioned in the ion beam flight path after the magnetic sector.

FIG. 2 generally designates at 2' the embodiment of FIG. 1 with an additional electrostatic sector placed in the path of the ion beam emerging from the magnetic sector. Vacuum chamber wall 4', and corresponding top and bottom members 6' and 8' sealed thereto, are shaped somewhat differently than vacuum chamber wall 4 in FIG. 1 to accommodate the additional electrostatic sector. For the sake of simplicity, the embodiments of FIGS. 1 and 2 will, therefore, be described together, it being understood that the description of the second electrostatic sector does not apply to the embodiment of FIG. 1.

Referring then to both FIGS. 1 and 2, a source material to be ionized and then analyzed is fed into an ion chamber 20 via an entrance port 22. The source material fed into ion source 20 via port 22 may be the output of a chromatograph such as a gas chromatograph. Ion source 20 may comprise a commercially available ion source such as Part # 0981-82850-301, available from the Varian Company which is mountable to and through the wall of a vacuum chamber. Ion source 20 provides an ion beam, which emerges from ion source 20 within the vacuum chamber at 26, and which comprises ions of the material to be analyzed.

The ion beam, shown in dashed lines at A, enters adjustable electrostatic sector 30, which will be described in more detail below, wherein ion beam A is accelerated and deflected approximately 90°.

Ion beam A leaving electrostatic sector 30 then enters adjustable magnetic sector 70, which will also be described in more detail below. Ion beam A is again focused and deflected again approximately 90° before emerging from magnetic sector 70.

At this point, in the embodiment of FIG. 1, ion beam A enters detector 150, which may comprise a commercial ion detector such as a Model GHP71 Channeltron, available from the Galileo Company. In the embodiment of FIG. 2, after emerging from magnetic sector 60, ion bean A enters a second electrostatic sector 160 where the beam is again accelerated prior to entering detector 150 in the embodiment of FIG. 2.

The ion optics used in the spectrometer of the invention, as will be described below, are defined by the following equation:

$$\text{MASS DETECTED} = \frac{eR^2H^2}{2V}$$

Where:

e=charge=1

R=radius of electrostatic sectors (meters)

H=field strength of magnetic sector (Gauss)

v=accelerating voltage on electrostatic sectors

Thus, for a given electrostatic sector radius and magnetic field strength of the magnetic sector, the accelerating voltage applied to the electrostatic sectors will be varied to analyze for various masses. For example, when the radius of the electrostatic sectors is 3.75 cm. and the respective magnetic field strengths on the magnetic sector are 5000 Gauss, or 8500 Gauss, the relationship of mass to accelerating voltage as is follows:

TABLE

| Voltage | 5000 Gauss Mass (AMU) | 7500 Gauss Mass (AMU) | 8500 Gauss Mass (AMU) |
|---|---|---|---|
| 50 | 339.33 | 763.49 | 980.66 |
| 75 | 226.22 | 508.99 | 653.78 |
| 100 | 169.66 | 381.75 | 490.33 |
| 125 | 135.73 | 305.40 | 392.27 |
| 150 | 113.11 | 254.50 | 326.89 |
| 175 | 96.95 | 218.14 | 280.19 |
| 200 | 84.83 | 190.87 | 245.17 |
| 225 | 75.41 | 169.66 | 217.93 |
| 250 | 67.87 | 152.70 | 196.13 |
| 275 | 61.70 | 138.82 | 178.30 |
| 300 | 56.55 | 127.25 | 163.44 |
| 310 | 54.73 | 123.14 | 158.17 |
| 320 | 53.02 | 119.30 | 153.23 |
| 330 | 51.41 | 115.68 | 148.59 |
| 340 | 49.90 | 112.28 | 144.22 |

TABLE-continued

| Voltage | 5000 Gauss Mass (AMU) | 7500 Gauss Mass (AMU) | 8500 Gauss Mass (AMU) |
|---|---|---|---|
| 350 | 48.48 | 109.07 | 140.09 |

It will be appreciated, of course, that the above voltages and field strengths are only representative. Higher voltages may be used and other magnetic field strengths may be used, depending upon the mass of the particular atom or molecule being analyzed. The magnetic field strength of the magnetic sector may be varied by opening the vacuum chamber and physically changing the magnets, or more preferably, placing additional magnets adjacent the magnetic sector, but external to the vacuum housing, to either increase the magnetic field (when the external magnets are magnetically oriented in the same direction as the respective internal magnets); or to decrease the magnetic field strength (when the external magnets are magnetically oriented in the opposite direction to the respective internal magnets). The field strength of the magnets in the magnetic sector may also be reduced by the placement of steel plates external to the vacuum chamber, but adjacent to the magnetic sector to quench the magnetic field.

b. Adjustable Electrostatic Sector

Figure 3:
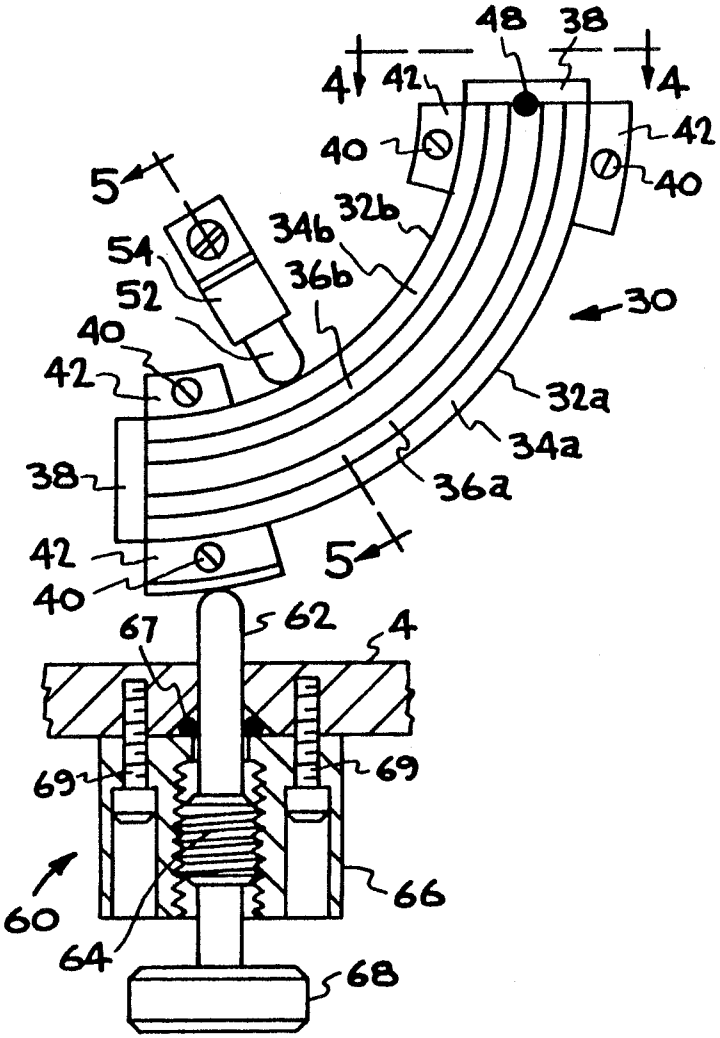
FIG. 3 is a fragmentary top view of a portion of FIG. 2 showing the adjustment means for one of the electrostatic sectors.
Figure 4:
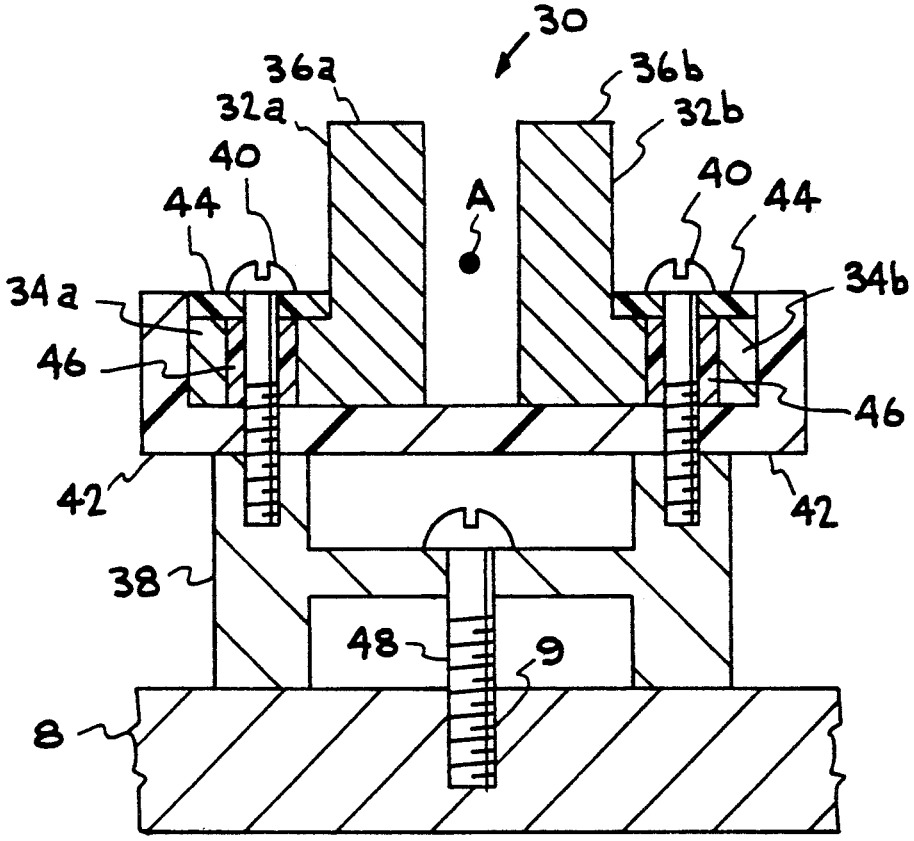
FIG. 4 is a vertical section view adjacent one end of one of the electrostatic sectors at the pivot point of the electrostatic sector.
Figure 5:
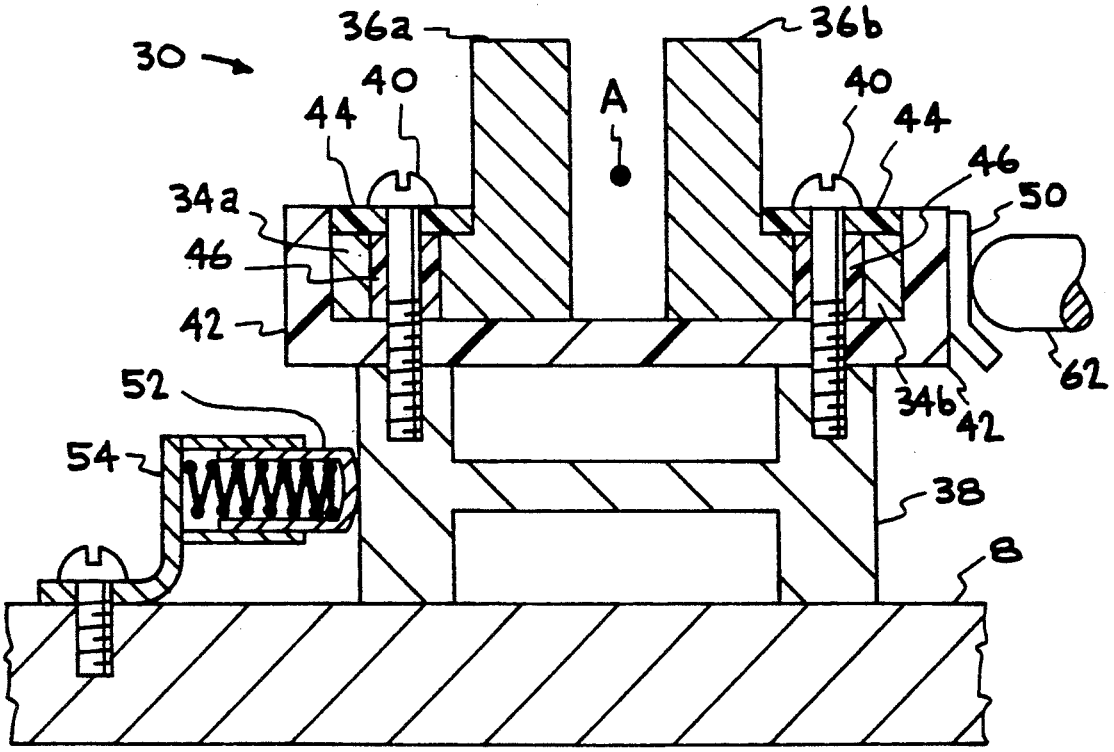
FIG. 5 is a vertical section view adjacent the opposite end of the electrostatic sector of FIG. 4 showing the adjustment means engaging the side of the electrostatic sector.

Adjustable electrostatic sector 30, generally shown in the embodiments of FIGS. 1 and 2 and shown in more detail in FIGS. 3–5, provides the initial focus and acceleration of beam A as it leaves ion source 20 at 26. Electrostatic sector 30 comprises a pair of perfectly curved 90° sector metal electrodes 32*a* and 32*b*, each respectively comprising a horizontal leg, 34*a* and 34*b*, and vertical members 36*a* and 36*b* between which ion beam A passes and which are insulatively mounted an equidistance apart on an H-shaped metal frame 38.

Curved electrodes 32*a* and 32*b* are insulatively fastened to frame 38 adjacent the opposite ends of the electrodes by machine screws 40. Electrodes 32*a* and 32*b* are insulated from metal H frame 38 by U-shaped insulator spacer 42 which may comprise a ceramic insulation material and which are positioned between electrodes 32*a*, 32*b* and the underlying H frame where screws 40 respectively pass through horizontal portions 34*a* and 34*b* of electrode 32*a* and 32*b*. Screws 40 are insulated from electrodes 32*a* and 32*b* by the provision of insulator washers 44 under the heads of screws 40 and insulator sleeves 44 in the holes in horizontal portions 34*a* and 34*b* of electrodes 32*a* and 32*b* through which screws 40 pass. In the illustrated embodiment, electrodes 32*a* and 32*b* are spaced about 0.5 cm. apart, although this may be varied somewhat. The radius of the centerline arc between electrode 32*a* and 32*b*, in the illustrated embodiment, is approximately 3.75 cm.

Electrodes 32*a* and 32*b* are shown electrically connected to an electrical connector 16 in FIG. 1 mounted in sidewall 4 of the vacuum chamber to permit connection of a power supply (not shown) to the electrostatic sector. Electrical connector 16' shown in FIG. 2 serves the same purpose when more than one sector is utilized. As is well known, the voltage applied to electrodes 32*a* and 32*b* is approximately 10% of the accelerating voltage used in ion source 20 to initially accelerate ion beam A, and this voltage may be adjusted at the power supply to electronically tune the sector as desired, and as is well known to those skilled in the art.

As best seen in FIGS. 3 and 4, electrostatic sector 30 is pivotally mounted, at one end, to bottom wall 8 of the mass spectrometer by a pivot pin 48, which may comprise a threaded member such as the illustrated screw, or an unthreaded member such a pin or rivet, passing through the central portion of frame 38 and received in a bore 9 in bottom wall 8.

Ion beam A, as it passes through electrostatic sector 30, may be focused by moving electrostatic sector 30 about its pivot pin 48. This movement or focusing of electrostatic sector 30 is accomplished external of the vacuum chamber by external adjustment mechanism 60 which is sealingly mounted to vacuum chamber sidewall 4 of mass spectrometer 2. Adjustment mechanism 60 comprises a pin 62 which passes through an opening in vacuum chamber sidewall 4 to engage a metal strip 50 which is bonded to the side edge of insulator 42. As best seen in FIG. 3, pin 62 has an enlarged threaded portion 64 which is received in an internally threaded housing 66 mounted to the external surface of vacuum chamber sidewall 4 and an enlarged handwheel 68 which is used to rotate pin 62 in housing 66 to urge pin 62 either toward or away from electrostatic sector 30.

Housing 66 is mounted to sidewall 4 by bolts 69 and both housing 66 and pin 62 are sealed to sidewall 4 by an o-ring 67 which fits into a beveled edge on the opening in sidewall 4 through which pin 62 passes.

Electrostatic sector 30 is also provided with a spring bias member 52, contained in a spring housing 54 fastened to bottomwall 8. Spring bias member 52, which bears against the opposite side of sector 30, urges electrostatic sector 30 against pin 62 to oppose the movement of electrostatic sector 30 by pin 62. Thus, once the proper adjustment or focusing of electrostatic sector 30 has been made, the tension of spring bias member 52 against sector 30 and pin 62 maintains sector 30 properly focused.

c. Adjustable Magnetic Sector

Figure 9:
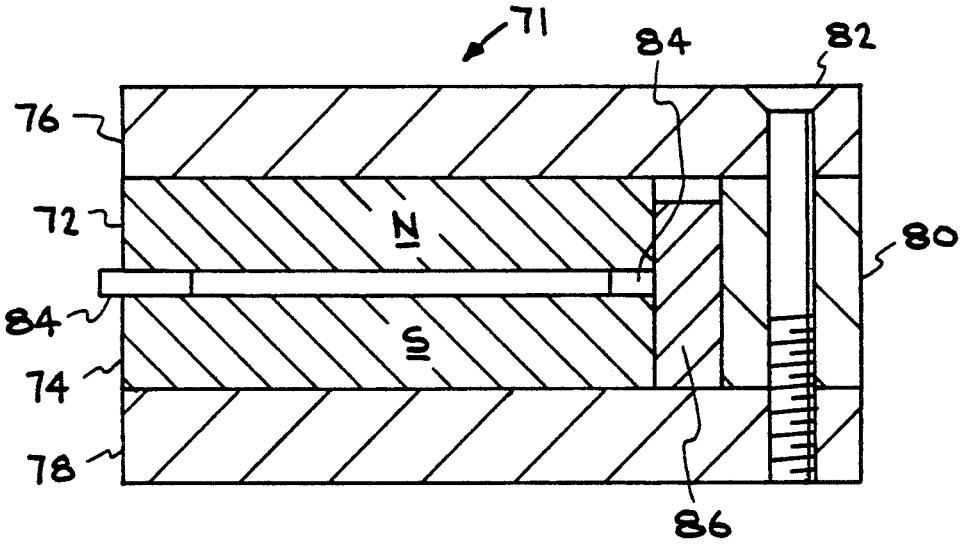
FIG. 9 is a vertical side section view of the magnets and magnet frame comprising the magnetic sector.
Figure 10:
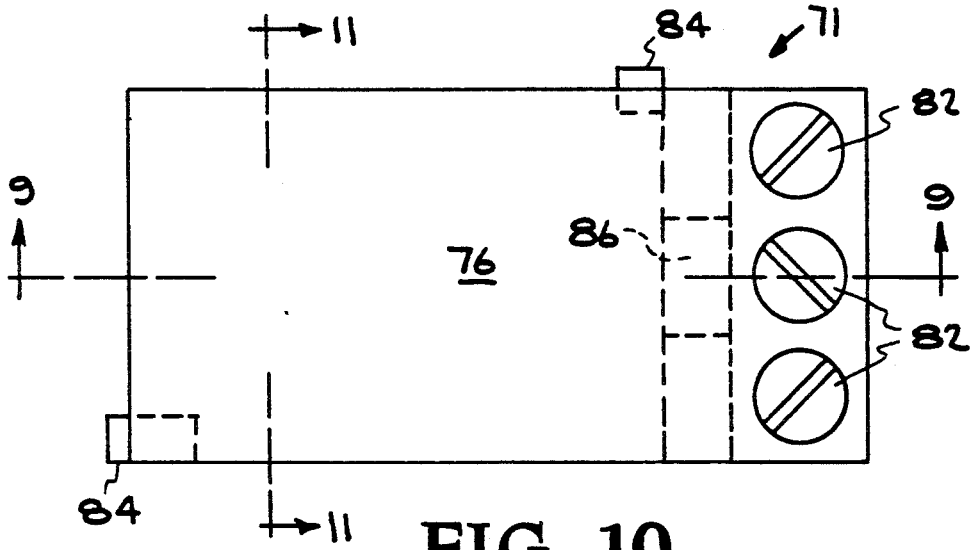
FIG. 10 is a top view of the magnet frame comprising the magnetic sector, with the upper magnet and spacers shown in dotted lines.
Figure 11:
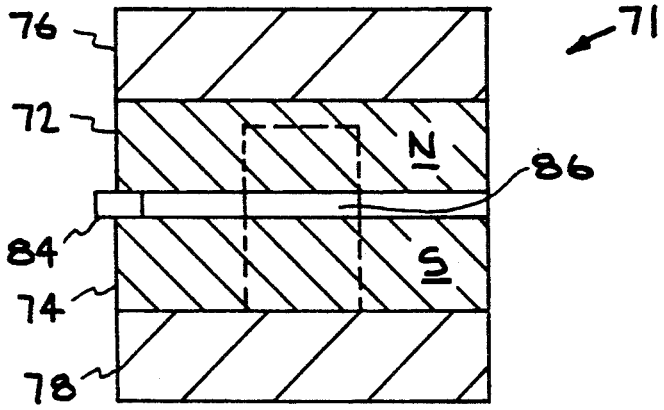
FIG. 11 is a vertical end section view of the magnets and magnet frame comprising the magnetic sector.

Adjustable magnetic sector 70 comprises a magnet and frame assembly 71 which includes a pair of very strong magnets mounted in a frame or yoke carried on a sliding mechanism which permits the magnets to be adjusted for focusing of the ion beam as it passes between the poles of the magnets. Referring to FIGS. 9–11, permanent magnets 72 and 74 are shown mounted within a yoke comprising upper member 76, lower member 78 and central yoke member 80 therebetween. Yoke members 76, 78, and 80 are secured together by screws 82. Yoke members 76, 78, and 80 may comprise any paramagnetic material capable of magnetically coupling magnets 72 and 74 together. Preferably, a ferromagnetic material is used which, most preferably, comprises a high magnetic susceptability steel such as Swedish Steel, fully annealed, to provide the needed strength as well as paramagnetic properties.

Magnets 72 and 74 may comprise commercially available nickel/cobalt/iron alloy magnets, or magnets containing rare earth materials such as, for example, samarium cobalt magnets or neodumium iron boron magnets. Magnets 72 and 74 should have a field strength of about 4–10 kilogauss. Magnets 72 and 74, which may be about 2"×2" square with a thickness of about ½", are mounted within yoke members 76, 78, and 80 spaced apart about 2.5 millimeter (mm), i.e., to provide a 2.5 mm gap between the poles of the resulting magnet. This 2.5 mm gap is maintained both by the thickness of yoke member 80 as well as the provision of several spacers 84 within the gap which are formed of a non-magnetic materials, such as aluminum. An additional non-magnetic spacer 86 is provided between the end edges of magnets 72 and 74 and the side edge of yoke member 80 as shown in FIG. 9, as well as in dotted lines in FIG. 10.

Magnet and frame assembly 71 is mounted on a movable platform 90 by screws (not shown) or other suitable fastening means to permit adjustment of magnetic sector 70 for alignment of ion beam A as its passes through magnetic sector 70, i.e., as beam A passes between magnets 72 and 74.

Figure 8:
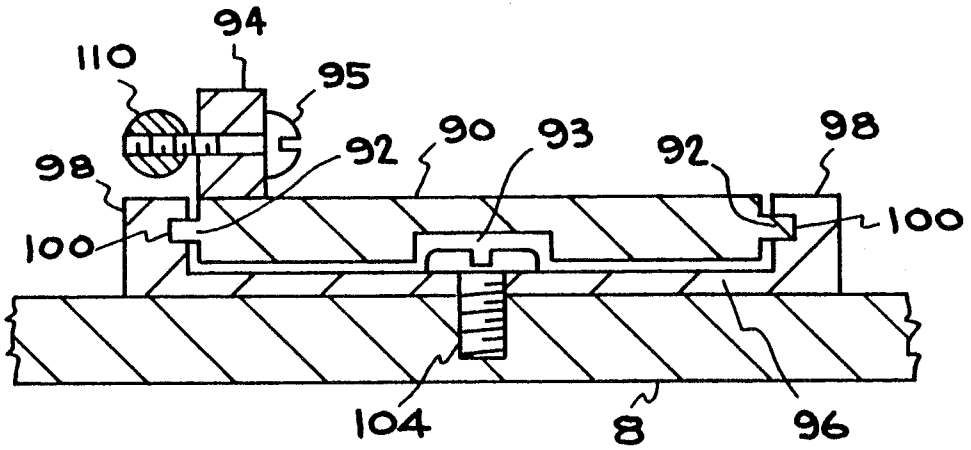
FIG. 8 is a vertical end section view of the adjustment means shown in FIG. 7.

Movable platform 90 is slidably received in a stationary mount 96, as best seen in FIG. 8, which is secured to bottomwall 8 of the vacuum chamber by screws 104. Stationary mount 96 is provided with side rails 98 on opposite sides thereof which are each provided with a groove 100 on the side surfaces of rails 98 which face one another. Corresponding tabs 92 formed on opposite side surfaces of platform 90 slidably fit into grooves 100 to permit platform 90 to slide along stationary mount 96. A groove or slot 93 may be provided along the underside of platform 90 to permit the heads of mounting screws 104 to protrude from mount 96. This may be necessary or desirable to permit platform 90 to be constructed of thinner material to reduce both bulk and weight. Otherwise, screws 104 may be recessed into mount 96 and slot 93 eliminated.

Figure 6:
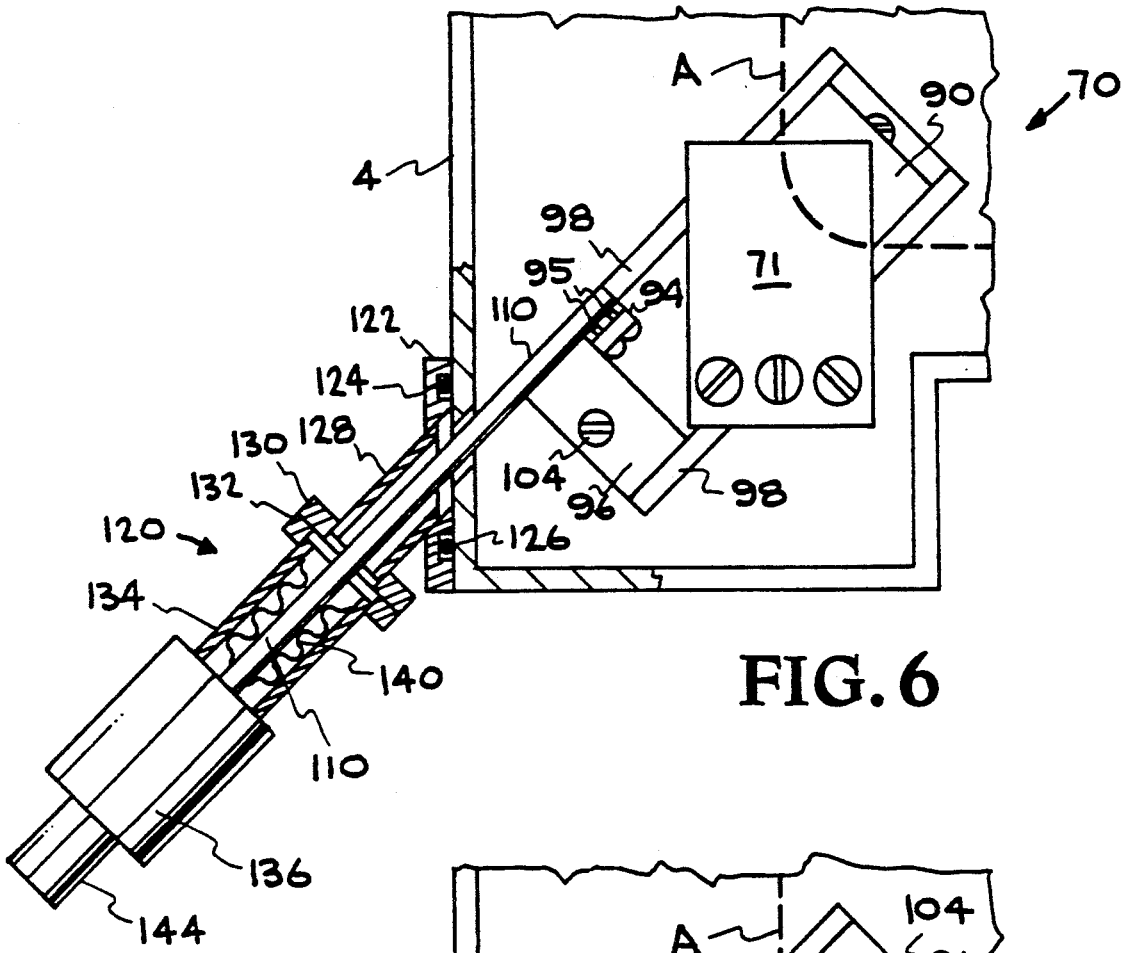
FIG. 6 is a fragmentary top view of a portion of FIG. 2 showing the adjustment means for the magnetic sector.
Figure 7:
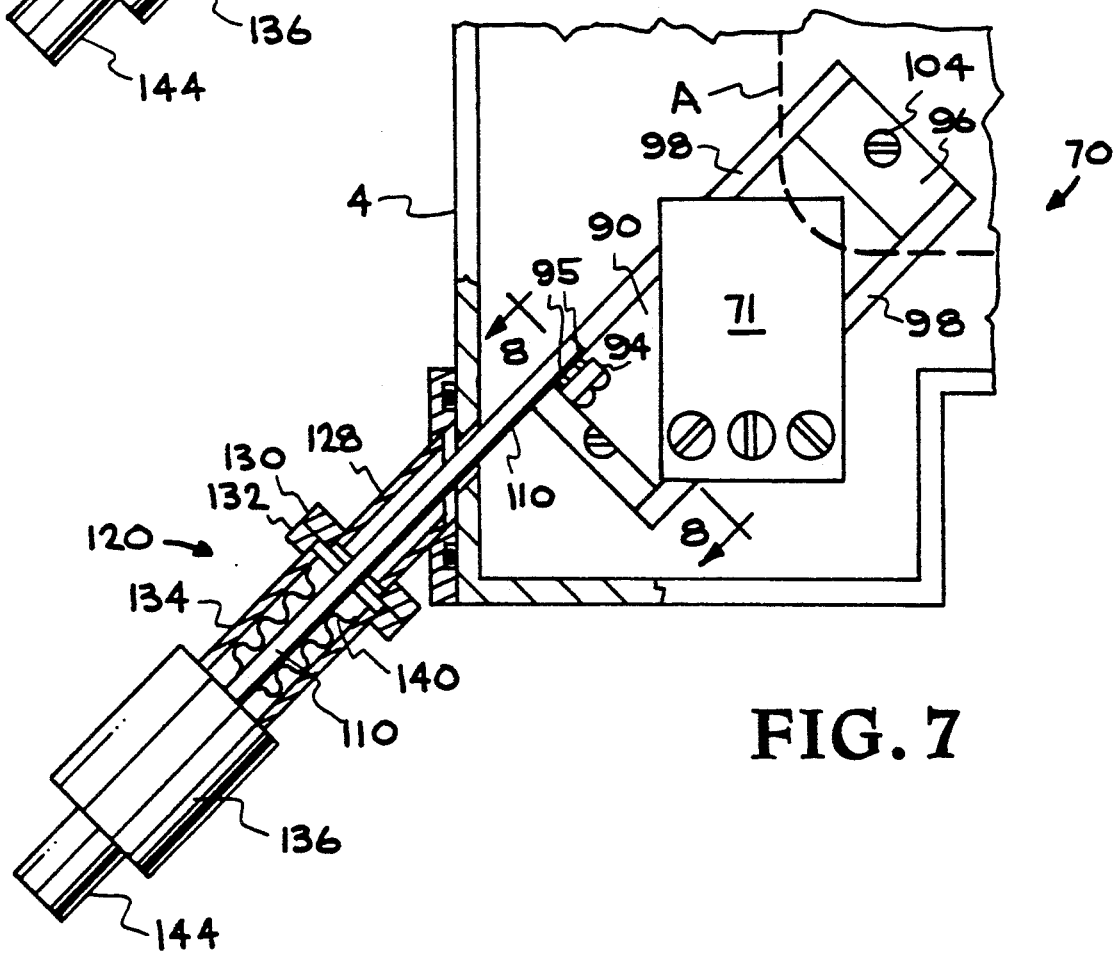
FIG. 7 is a fragmentary top view similar to FIG. 6 except that the adjustment means have been moved to a second position.

Movable platform 90 is further provided with a raised mount 94 to which is fastened an adjustment rod 110 via screws 95 or other appropriate fastening means. As seen by comparing the position of rod 110 and movable platform 90 respectively in FIGS. 6 and 7, one can see that movement of rod 110 along an axis parallel to the axis of stationary mount 96 causes movable platform 90 to slide in mount 96, which in turn causes movement of magnet and frame assembly 71, to permit adjustment of magnetic sector 70 with respect to the path of ion beam A.

It will be noted, in this regard, that mount 96 and slidable platform 90 thereon, have been mounted on bottomwall 8 of mass spectrometer 2 at an angle of about 45° with respect to the flight path of ion beam A, but that magnet and frame assembly 71 have been mounted on platform 90 to provide a side edge or face of the magnets in assembly 71 which is normal or perpendicular to the beam path. By positioning mount 96 and sliding platform 90 at a 45° to the beam path, movement of magnetic sector 70 by movement of adjusting rod 110 will always maintain the side edge of the magnets normal to the path of incoming ion beam A.

To provide for external adjustment or focusing of magnetic sector 70, adjusting rod 110 passes through vacuum chamber sidewall 4 to an adjustment assembly 120. Adjustment assembly 120 is sealingly mounted to the outside surface of sidewall 4 by a flange 122 which contains an o-ring seal 124 carried in a groove 126 therein. Adjustment assembly 120 may comprise a commercially available assembly such as a UHV 1" linear feedthrough, available from the MDC Company.

Assembly 120 further consists of a sleeve 128 fastened, at one end, to flange 122, and at its opposite end to a flange 130. Flange 130 is secured to another flange 132 on the end of a sleeve 134 which has an enlarged portion 136. To maintain the vacuum seal, a bellows 140 is welded, at one end, to shaft 110 and, at the opposite end, to the inner surface of sleeve 134. An adjustment knob 144 is mounted on the end of shaft 110. When knob 144 is turned, shaft 110 rotates and thereby travels into or out of the vacuum chamber to thereby adjust magnetic sector 70.

d. Second Adjustable Electrostatic Sector

After emerging from adjustable magnetic sector 70, ion beam A enters detector 150 in the embodiment shown in FIG. 1. However, in the embodiment illustrated in FIG. 2, ion beam A is electrostatically focused and accelerated a second time by passage of beam A through a second electrostatic sector 160. Electrostatic sector 160, as shown in FIG. 2, also comprises an externally adjustable electrostatic sector which is identical in both shape and function to electrostatic sector 30 shown in FIG. 2, except that electrostatic sector 160 is reversed from electrostatic sector 30. Adjustment of electrostatic sector 160 is, therefore, identical to the adjustment of sector 30, using a second adjustment mechanism 60 mounted on the outside of sidewall 4 and coupled to sector 160 within the vacuum chamber.

e. Mass Spectrometer with Circular Beam Path

Figure 12:
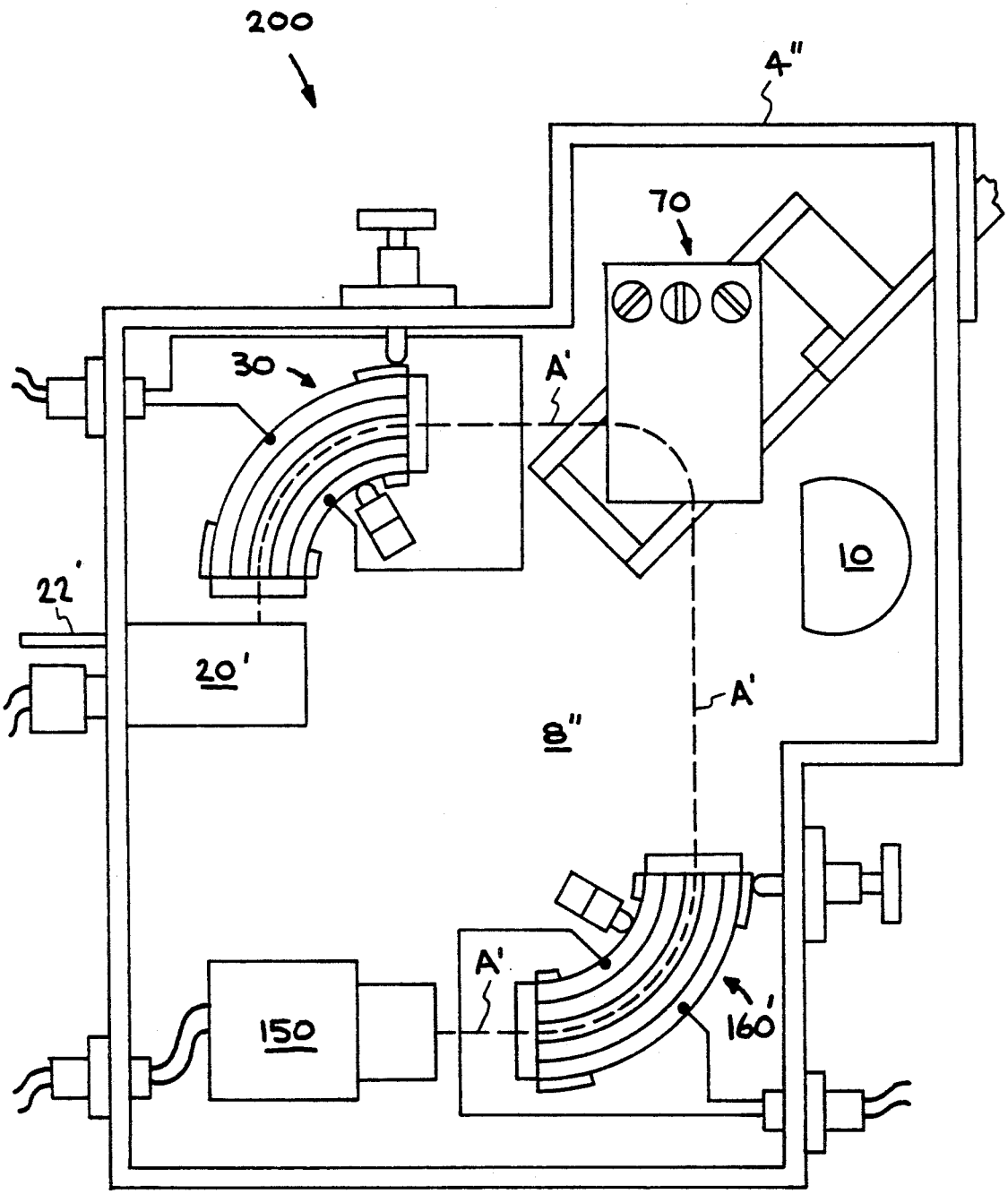
FIG. 12 is a partially cutaway top view of yet another embodiment of the mass spectrometer of the invention wherein a first electrostatic sector is positioned in the ion beam flight path before the magnetic sector and a second electrostatic sector is positioned in the ion beam flight path after the magnetic sector and both electrostatic sectors and the magnetic sector are positioned to deflect the ion beam in the same generally circular direction for a total deflection of about 270°.
Figure 13:
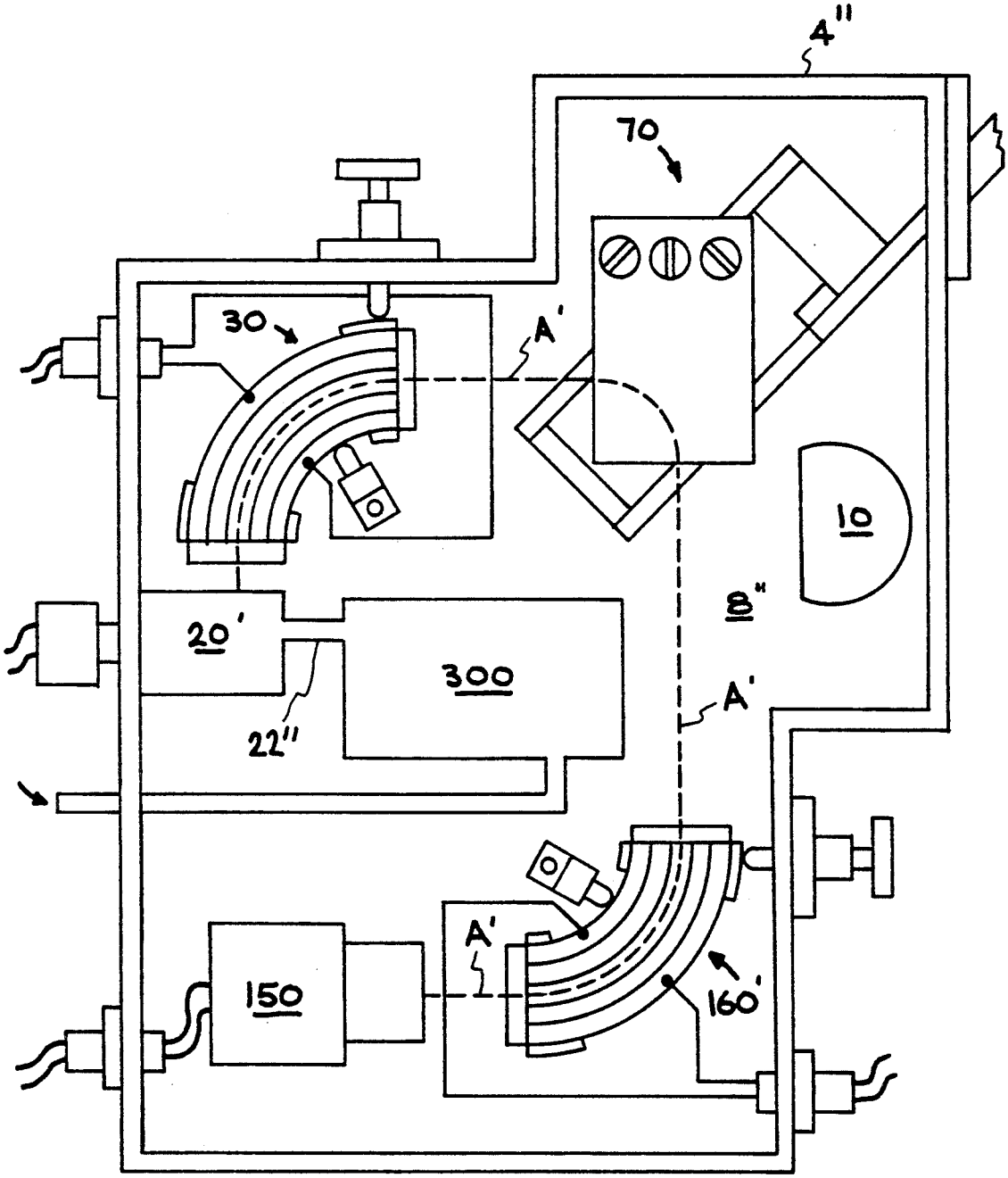
FIG. 13 is a partially cutaway top view of still another embodiment of the mass spectrometer of the invention wherein the electrostatic sectors and the magnetic sector are all positioned to deflect the ion beam in the same generally circular direction for a total deflection of about 270°, as in the embodiment of FIG. 12, and a sealed chromatograph is located in the central portion of the structure.

Turning now to FIG. 12, another embodiment of the invention is generally illustrated at 200 comprising a mass spectrometer wherein a second electrostatic sector 160' is reversed from the disposition of sector 160 in the embodiment of FIG. 2 whereby the beam path of ion beam A' follows a generally circular path through 270° in the same direction. In the embodiment illustrated in FIG. 12, most of the components are identical to those shown in FIG. 2 and have been identically numbered accordingly. However, it will be noted that the vacuum chamber geometry has been slightly altered to accommodate the circular beam path and the sidewall os, therefore denoted as 4" and the bottomwall has been denoted as 8". The ion source 20' is also arranged slightly differently in this embodiment, but performs the identical function of generating an ion beam from the material to be analyzed entering entrance port 22'.

f. Mass Spectrometer with Circular Beam Path and Centrally Positioned Chromatograph FIG. 13 illustrates yet another embodiment of the mass spectrometer of the invention which is similar to the circular beam path arrangement shown in the previous embodiment, but wherein the central space is utilized to provide for the housing of a chromatograph 300 which can then be coupled to the input port of ion source 20'. While chromatograph 300 is shown as housed within sidewall 4" of the vacuum chamber, it will be understood that the vacuum chamber walls may be reconfigured to permit the central mounting of chromatograph 300 as shown, but outside of sidewalls 4", i.e., outside of the vacuum chamber.

Thus, the invention provides for a portable mass spectrometer which may be mounted in a case and transported with external adjustment controls provided for external adjustment of either the electrostatic sector, or sectors, or the magnetic sector so that minor misadjustments, which may occur, for example, due to the transporting of the spectrometer. Mounting of the magnetic sector wholly within the vacuum chamber provides for a more compact arrangement and permits reduction of both the weight and size of the magnets used in the magnetic sector.

While specific embodiments of the portable mass spectrometer of the invention have been illustrated and described for constructing the apparatus in accordance with this invention, modifications and changes of the apparatus, parameters, materials, etc. will become apparent to those skilled in the art, and it is intended to cover in the appended claims all such modifications and changes which come within the scope of the invention.

What is claimed is:

1. A portable mass spectrometer comprising:

a) a vacuum chamber;
b) a source of material to be analyzed;
c) an ionization chamber coupled to said vacuum chamber and adapted to receive material to be analyzed from said source and to form an ion beam comprising ions of said material;
d) an adjustable electrostatic sector in said vacuum chamber generally aligned with the ion beam emerging from said ionization chamber;
e) "mechanical" means for adjusting said electrostatic sector to focus said ion beam;
f) an adjustable magnetic sector in said vacuum chamber generally aligned with the path of said ion beam emerging from said electrostatic sector;
g) "mechanical" means for adjusting said magnetic sector to focus said ion beam; and
h) detection means for detecting the ion beam focused by said electrostatic sector and said magnetic sector.

2. The portable mass spectrometer of claim 1 wherein said magnetic sector further comprises magnets mounted within said vacuum chamber.

3. The portable mass spectrometer of claim 2 wherein said "mechanical" means for adjusting said electrostatic sector within said vacuum chamber are accessible from outside said vacuum chamber.

4. The portable mass spectrometer of claim 2 wherein said "mechanical" means for adjusting said magnetic sector within said vacuum chamber are accessible from outside said vacuum chamber.

5. The portable mass spectrometer of claim 2 wherein a second adjustable electrostatic sector, with mechanical adjustment means accessible from outside said vacuum chamber, is positioned within said vacuum chamber generally aligned with the path of said ion beam emerging from said magnetic sector and between said magnetic sector and said detection means.

6. The portable mass spectrometer of claim 2 wherein said electrostatic sector comprises a pair of curved electrodes which deflect said ion beam into a path approximately 90° from the path of the ion beam entering said electrostatic sector.

7. The portable mass spectrometer of claim 6 wherein said magnetic sector comprises a pair of magnets in said chamber positioned respectively on opposite sides of said ion beam path to deflect said ion beam into a path approximately 90° from the path of the ion beam entering said magnetic sector.

8. The portable mass spectrometer of claim 7 wherein the direction of curvature of said ion beam in said magnetic sector is the same as in said electrostatic sector, whereby said ion beam is collectively deflected about 180° by said electrostatic sector and said magnetic sector.

9. The portable mass spectrometer of claim 8 wherein the deflection of said ion beam in said magnetic sector is in the same plane as the deflection of said ion beam in said electrostatic sector.

10. The portable mass spectrometer of claim 9 wherein a second adjustable electrostatic sector, with mechanical adjustment means accessible from outside said vacuum chamber, is positioned within said vacuum chamber generally aligned with the path of said ion beam emerging from said magnetic sector and between said magnetic sector and said detection means and the deflection of said ion beam in said second electrostatic sector is in the same plane as the deflection of said ion beam in said magnetic sector and first electrostatic sector.

11. The portable mass spectrometer of claim 10 wherein the direction of curvature of said ion beam in said second electrostatic sector is opposite to that of said magnetic sector and said first electrostatic sector, whereby said ion beam is collectively deflected about 90° by said electrostatic sectors and said magnetic sector.

12. The portable mass spectrometer of claim 10 wherein the direction of curvature of said ion beam in said second electrostatic sector is the same as in said magnetic sector and said first electrostatic sector, whereby said ion beam is collectively deflected about 270° by said electrostatic sectors and said magnetic sector.

13. The portable mass spectrometer of claim 12 wherein a chromatograph, positioned within the area defined by said circular beam, is coupled to said ion source.

14. A portable mass spectrometer comprising:
a) a vacuum chamber;
b) a source of material to be analyzed;
c) an ionization chamber coupled to said vacuum chamber and adapted to receive material to be analyzed from said source and to form an ion beam comprising ions of said material;
d) a first adjustable electrostatic sector in said vacuum chamber generally aligned with the ion beam emerging from said ionization chamber;
e) means accessible from outside said vacuum chamber for positionally adjusting said first electrostatic sector to focus said ion beam;
f) an adjustable magnetic sector in said vacuum chamber generally aligned with the path of said ion beam emerging from said electrostatic sector and comprising magnets mounted within said vacuum chamber;
g) means accessible from outside said vacuum chamber for positionally adjusting said magnetic sector to focus said ion beam;
h) a second adjustable electrostatic sector in said vacuum chamber generally aligned with the ion beam emerging from said magnetic sector;
i) means accessible from outside said vacuum chamber for positionally adjusting said second electrostatic sector to focus said ion beam; and
j) detection means for detecting the ion beam focused by said electrostatic sectors and said magnetic sector.

15. The mass spectrometer of claim 14 wherein said first adjustable electrostatic sector comprise a pair of curved electrodes spaced equidistantly apart and mounted on a frame which is pivotally mounted, adjacent one end of said electrodes, to a wall of said vacuum chamber.

16. The mass spectrometer of claim 15 wherein said means positionally adjusting for said first electrostatic sector accessible from outside said vacuum chamber further comprises a pin which has a first end within said vacuum chamber in operational contact with the non-pivotally mounted end of said electrodes and a second end of said pin outside of said chamber to permit pivotal movement of said electrostatic sector from outside said vacuum chamber.

17. The mass spectrometer of claim 16 wherein bias means within said vacuum chamber urge said electrostatic sector against said pin.

18. The mass spectrometer of claim 14 wherein said magnets in said magnetic sector are mounted within a frame connected to slidable means within said chamber connected to one end of a rod having a second end outside of said vacuum chamber to permit external adjustment of said magnetic sector.

19. The mass spectrometer of claim 18 wherein said slidable means in said vacuum chamber, on which said magnets and said magnet frame in said magnetic sector are mounted, is positioned to move said magnets at an angle of approximately 45° with respect to the beam path so that the side edge of said magnets facing said beam path is perpendicular to said beam path.

20. A portable mass spectrometer comprising:

a) a vacuum chamber;

b) a source of material to be analyzed;

c) an ionization chamber coupled to said vacuum chamber and adapted to receive material to be analyzed from said source and to form an ion beam comprising ions of said material;

d) a first adjustable electrostatic sector in said vacuum chamber generally aligned with the ion beam emerging from said ionization chamber comprising a pair of curved electrodes spaced equidistantly apart and mounted on a frame which is pivotally mounted, adjacent one end of said electrodes, to a wall of said vacuum chamber;

e) mechanical means accessible from outside said vacuum chamber for positionally adjusting said first electrostatic sector to focus said ion beam comprising a first pin having a first end within said vacuum chamber in operational contact with the non-pivotally mounted end of said electrodes and a second end of said first pin outside of said chamber to permit pivotal movement of said first electrostatic sector from outside said vacuum chamber;

f) first bias means within said vacuum chamber to urge said first electrostatic sector against said first pin;

g) an adjustable magnetic sector in said vacuum chamber generally aligned with the path of said ion beam emerging from said electrostatic sector and comprising magnets mounted within said vacuum chamber within a frame connected to slidable means within said chamber;

h) mechanical means accessible from outside said vacuum chamber for positionally adjusting said magnetic sector to focus said ion beam comprising a rod connected at one end to said slidable means and having a second end outside of said vacuum chamber to permit said external adjustment of said magnetic sector;

i) a second adjustable electrostatic sector in said vacuum chamber generally aligned with the ion beam emerging from said magnetic sector comprising a second pair of curved electrodes spaced equidistantly apart and mounted on a frame which is pivotally mounted, adjacent one end of said electrodes, to a wall of said vacuum chamber;

j) mechanical means accessible from outside said vacuum chamber for positionally adjusting said second electrostatic sector to focus said ion beam comprising a second pin having a first end within said vacuum chamber in operational contact with the non-pivotally mounted end of said second pair of electrodes and a second end of said second pin outside of said chamber to permit pivotal movement of said second electrostatic sector from outside said vacuum chamber;

k) second bias means within said vacuum chamber to urge said second electrostatic sector against said second pin; and l) detection means for detecting the ion beam focused by said electrostatic sectors and said magnetic sector.

* * * * *